US009661712B1

(12) United States Patent
Lai et al.

(10) Patent No.: US 9,661,712 B1
(45) Date of Patent: May 23, 2017

(54) LAMP WITH AUTOMATIC DIMMER

(71) Applicants: AVAVERTRONICS INC, Taichung (TW); DEPARTMENT OF ELECTRICAL ENGINEERING, NATIONAL CHANGHUA UNIVERSITY OF EDUCATION, Changhua (TW)

(72) Inventors: Bing-Yuan Lai, Taichung (TW); Yu-Lin Juan, Changhua (TW); Tsair-Rong Chen, Changhua (TW); Peng-Yuan Chen, Taichung (TW); Wei-Yuan Chen, Taichung (TW)

(73) Assignees: AVERTRONICS INC., Industrial, Nuntun Dist., Taichung (TW); DEPARTMENT OF ELECTRICAL ENGINEERING, NATIONAL CHANGHUA UNIVERSITY OF EDUCATION, Changhua (TW)

( * ) Notice: Subject to any disclaimer, the term of this patent is extended or adjusted under 35 U.S.C. 154(b) by 0 days.

(21) Appl. No.: 15/099,591

(22) Filed: Apr. 15, 2016

(51) Int. Cl.
*G05F 1/00* (2006.01)
*H05B 33/08* (2006.01)

(52) U.S. Cl.
CPC ..... *H05B 33/0851* (2013.01)

(58) Field of Classification Search
CPC ..... H05B 33/0815; H05B 33/0818; H05B 41/2828; H05B 41/3921; H05B 41/3927
USPC ..... 315/291, 307, 312, 224, 209 R
See application file for complete search history.

(56) References Cited

U.S. PATENT DOCUMENTS

2007/0040512 A1* 2/2007 Jungwirth ..... H05B 33/086 315/159
2010/0256450 A1* 10/2010 Choi ..... A61B 1/00071 600/182
2011/0291564 A1* 12/2011 Huang ..... F21V 23/0457 315/77
2012/0068600 A1* 3/2012 Hartmann ..... F21V 3/00 315/51
2013/0009551 A1* 1/2013 Knapp ..... H05B 33/0869 315/152
2014/0055990 A1* 2/2014 Reed ..... F21V 15/005 362/218

* cited by examiner

*Primary Examiner* — Minh D A

(57) ABSTRACT

A lamp includes a light source in a top of a housing, the light source including a driver, a light emitting member electrically connected to the driver, and a dimming controller electrically connected to the driver wherein the driver is configured to activate the light emitting member after being activated by a signal sent from the dimming controller; and an electro-optical sensor in the top of the housing and electrically connected to the dimming controller wherein light emitted by the light emitting member is reflected to the electro-optical sensor, and the electro-optical sensor sends the sensed light to the dimming controller. The dimming controller compares intensity of the sensed light with intensity of the light emitted by the light emitting member, and the driver either decreases the intensity of the light output or increases same based on the comparison.

6 Claims, 5 Drawing Sheets

LAMP WITH AUTOMATIC DIMMER

BACKGROUND OF THE INVENTION

1. Field of the Invention

The invention relates to dimmers and more particularly to a lamp having an automatic dimmer with improved characteristics.

2. Description of Related Art

Dimmers are devices used to lower the brightness of a light. By changing the voltage waveform applied to the lamp, it is possible to lower the intensity of the light output.

A conventional lamp having a step-wise dimmer switch capable of lowering the intensity of the light output to 75%, 50%, or 25% of its maximum intensity of the light output is commercially available.

Another conventional lamp has an automatic dimmer that can change seamlessly through a continuous range of intensity of the light output.

However, both conventional dimmers are manually controlled not automatic. That is, both cannot automatically dim or turn off the light in response to the light intensity of the environment.

Thus, the need for improvement still exists.

SUMMARY OF THE INVENTION

It is therefore one object of the invention to provide a lighting device comprising a housing; a light source disposed in a top of the housing, the light source including a driver, a light emitting member electrically connected to the driver, and a dimming controller electrically connected to the driver wherein the driver is configured to activate the light emitting member after being activated by a signal sent from the dimming controller; and an electro-optical sensor disposed in the top of the housing and electrically connected to the dimming controller wherein light emitted by the light emitting member is reflected to the electro-optical sensor, and the electro-optical sensor sends the sensed light to the dimming controller; wherein the dimming controller compares intensity of the sensed light with intensity of the light emitted by the light emitting member, and the driver either decreases the intensity of the light emitted by the light emitting member if the intensity of the sensed light is greater than that of the emitted light or increases the intensity of the light emitted by the light emitting member if the intensity of the sensed light is less than that of the emitted light.

The above and other objects, features and advantages of the invention will become apparent from the following detailed description taken with the accompanying drawings.

DETAILED DESCRIPTION OF THE INVENTION

Figure 1:
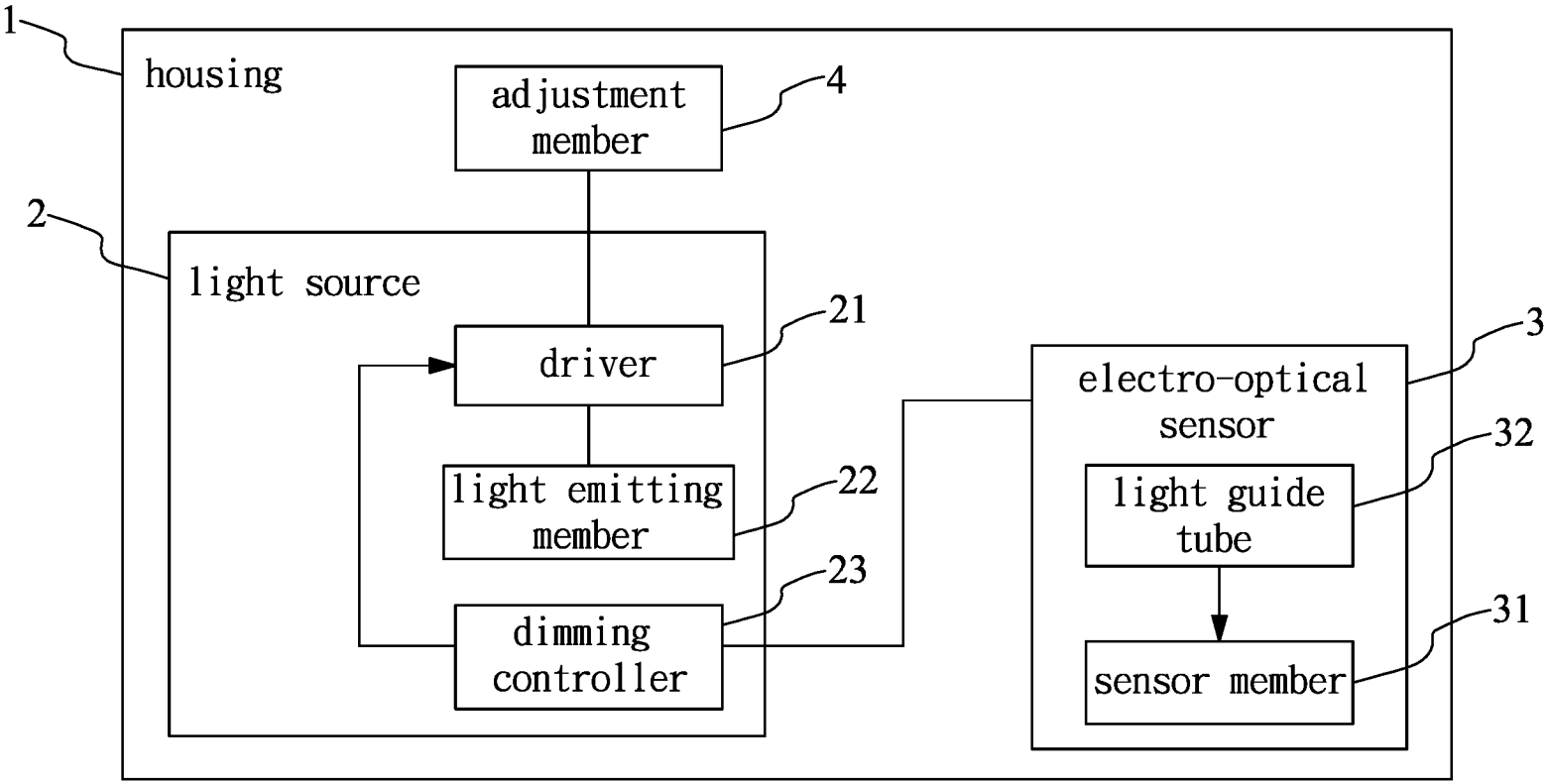
FIG. 1 is a block diagram of a lamp according to the invention.
Figure 2:
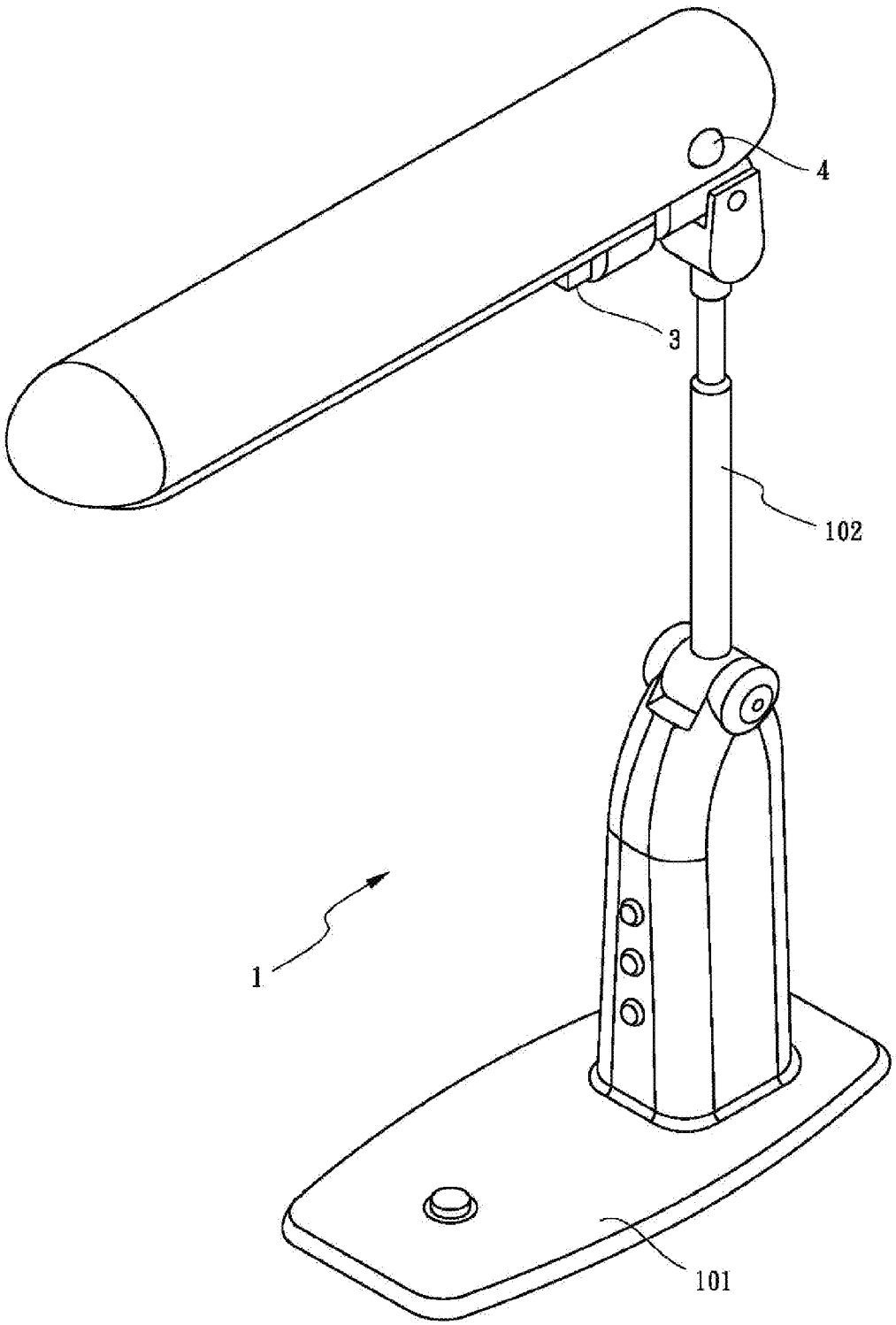
FIG. 2 is a perspective view of the lamp.
Figure 3:
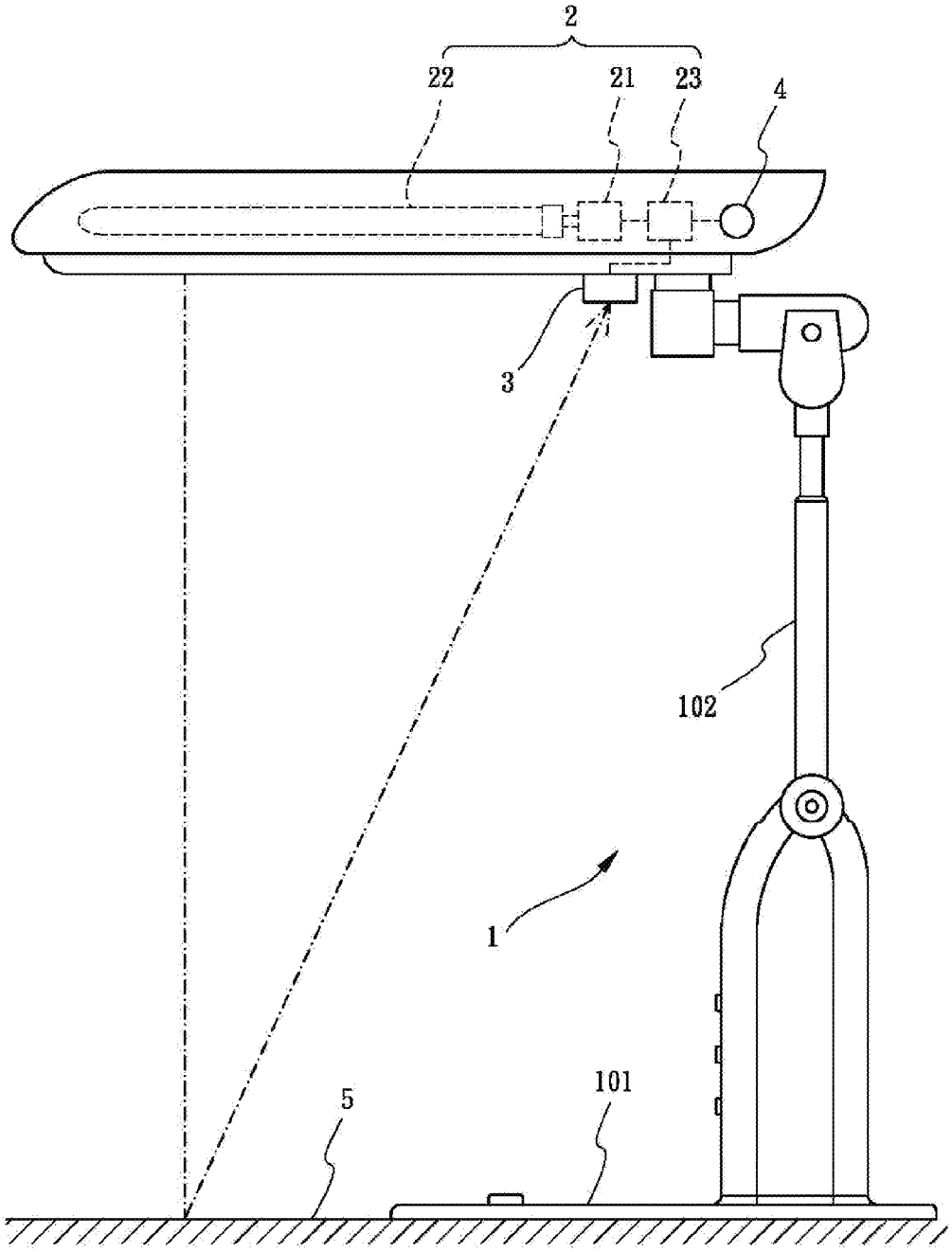
FIG. 3 is a side view of the lamp in a lighting state.
Figure 4:
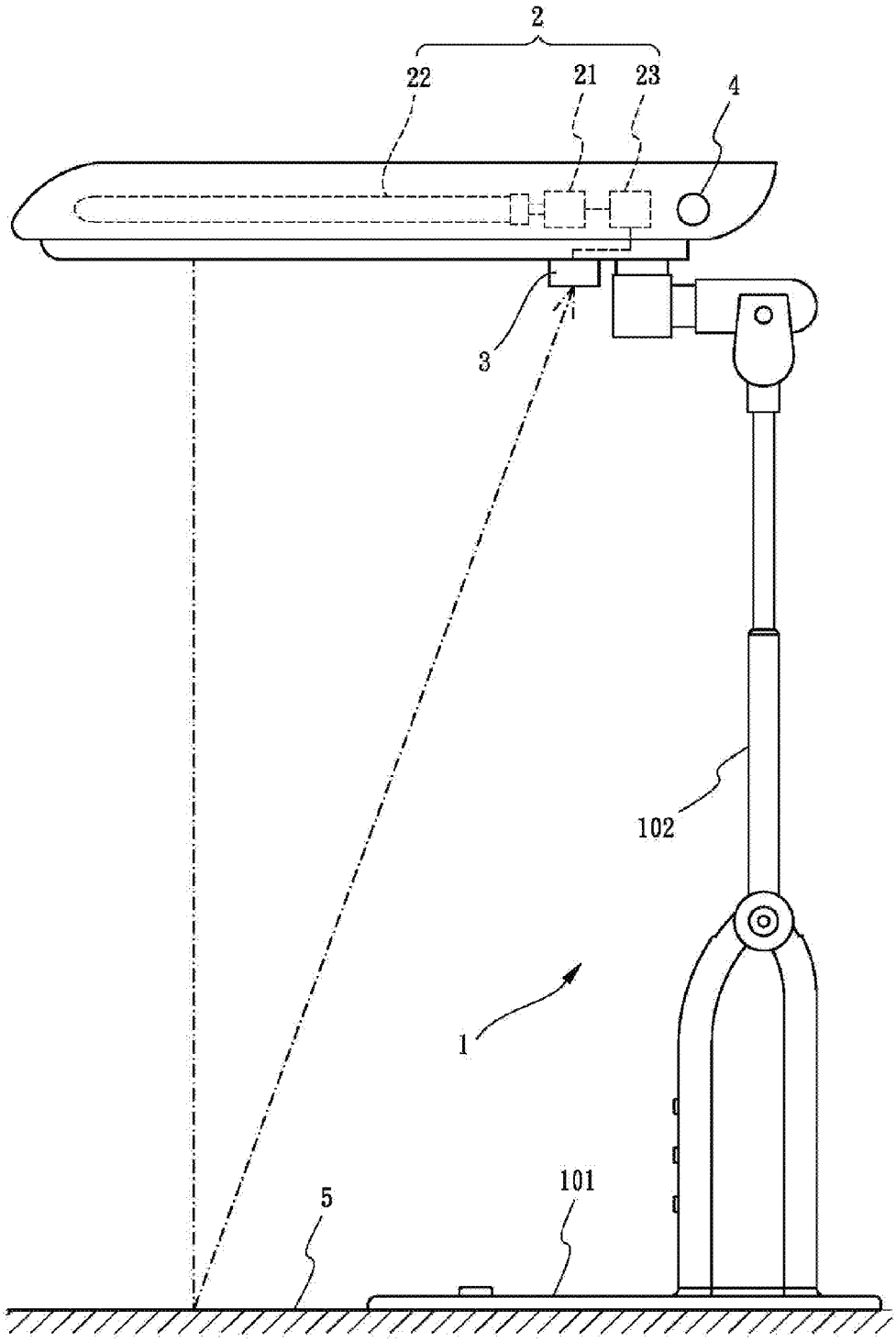
FIG. 4 is a view similar to FIG. 3 showing the dimmer being activated to adjust the intensity of the light output in response to the light intensity of the environment.
Figure 5:
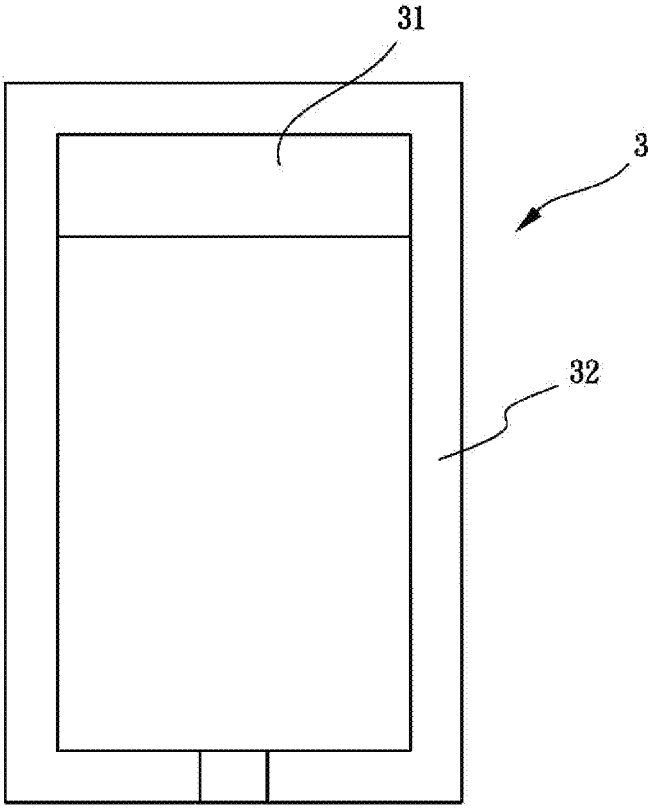
FIG. 5 is a schematic view of the electro-optical sensor.

Referring to FIGS. 1 to 5, a lamp in accordance with the invention comprises the following components as discussed in detail below.

A housing 1 and a light source 2 in a top portion of the housing 1 are provided. The light source 2 includes a driver 21, a light emitting member 22 electrically connected to the driver 21, and a dimming controller 23 electrically connected to the driver 21. The driver 21 may activate the light emitting member 22 after being activated by a signal sent from the dimming controller 23. An electro-optical sensor 3 is provided in the top portion of the housing 1 below the light source 2. The electro-optical sensor 3 is electrically connected to the dimming controller 23. Light emitted by the light emitting member 22 is reflected to the electro-optical sensor 3. The electro-optical sensor 3 then sends the sensed light to the dimming controller 23. Next the dimming controller 23 compares the intensity of the sensed light with the intensity of the light emitted by the light emitting member 22. The driver 21 decreases the intensity of the light emitted by the light emitting member 22 if the intensity of the sensed light is greater than that of the emitted light. To the contrary, the driver 21 increases the intensity of the light emitted by the light emitting member 22 if the intensity of the sensed light is less than that of the emitted light. The light intensity adjustment is automatic and this is the characteristic of the invention.

The lamp is implemented as a table lamp and the housing 1 includes a base 101 rested on a table 5, and a telescopic tube 102. The light source 2 and the electro-optical sensor 3 are provided on a top of the tube 102 so that a distance from the light source 2 to the table 5 can be adjusted by manipulating the tube 102. Light intensity of the reflected light can be decreased by increasing the distance from the light emitting member 22 to the table 5. Light emitted by the light emitting member 22 is reflected to the electro-optical sensor 3. The electro-optical sensor 3 then sends the sensed light to the dimming controller 23. Next the dimming controller 23 compares the intensity of the sensed light with the intensity of the light emitted by the light emitting member 22. The driver 21 increases the intensity of the light emitted by the light emitting member 22 because the intensity of the sensed light is less than that of the emitted light. To the contrary, after decreasing the distance from the light emitting member 22 to the table 5, the driver 21 decreases the intensity of the light emitted by the light emitting member 22 because the intensity of the sensed light is less than that of the emitted light.

The invention further comprises an adjustment member 4 electrically connected to the driver 21. Thus, a user may set intensity of light output of the light emitting member 22 by programming the adjustment member 4. And in turn, the dimming controller 23 may activate the driver 21 based on the setting. Specifically, the dimming controller 23 compares the intensity of the light sensed by the electro-optical sensor 3 with the intensity of the light emitted by the light emitting member 22. The driver 21 decreases the intensity of the light emitted by the light emitting member 22 if the intensity of the sensed light is greater than that of the emitted light. To the contrary, the driver 21 increases the intensity of the light emitted by the light emitting member 22 if the intensity of the sensed light is less than that of the emitted light. The light intensity adjustment is automatic.

The electro-optical sensor 3 includes a light guide tube 32 and a sensor member 31 mounted at one end of the light guide tube 32. Light emitted by the light emitting member 22 is reflected and the reflected light is sensed by the sensor member 31 after passing through the light guide tube 32. The sensor member 31 then sends the sensed light to the dimming controller 23. Next the dimming controller 23 compares the intensity of the sensed light with the intensity of the light emitted by the light emitting member 22. The driver 21 decreases the intensity of the light emitted by the light emitting member 22 if the intensity of the sensed light is greater than that of the emitted light. To the contrary, the driver 21 increases the intensity of the light emitted by the light emitting member 22 if the intensity of the sensed light is less than that of the emitted light. The light intensity adjustment is automatic. The light emitting member 22 is a light-emitting diode (LED). The light guide tuber 32 is either straight or V-shaped. Further, the housing 1 of the invention can be, in addition to the table lamp, a work lamp or a lamp for surgery.

While the invention has been described in terms of preferred embodiments, those skilled in the art will recognize that the invention can be practiced with modifications within the spirit and scope of the appended claims.

What is claimed is:

1. A lighting device comprising:

a housing;

a light source disposed in a top of the housing, the light source including a driver, a light emitting member electrically connected to the driver, and a dimming controller electrically connected to the driver wherein the driver is configured to activate the light emitting member after being activated by a signal sent from the dimming controller; and an electro-optical sensor comprising a light guide tube disposed in the top of the housing and a sensor member located at one end of the light guide tube and electrically connected to the dimming controller, wherein light emitted by the light emitting member is reflected to and sensed by the sensor member after passing through the light guide tube, and the sensor member sends the sensed light to the dimming controller so that the dimming controller compares intensity of the sensed light with intensity of the light emitted by the light emitting member and instructs the driver to reduce the intensity of the light emitted by the light emitting member if the intensity of the sensed light is greater than that of the emitted light or increase the intensity of the light emitted by the light emitting member if the intensity of the sensed light is less than that of the emitted light;

wherein the dimming controller compares intensity of the sensed light with intensity of the light emitted by the light emitting member, and the driver either decreases the intensity of the light emitted by the light emitting member if the intensity of the sensed light is greater than that of the emitted light or increases the intensity of the light emitted by the light emitting member if the intensity of the sensed light is less than that of the emitted light.

2. The lighting device of claim 1, further comprising an adjustment member electrically connected to the driver, and wherein intensity of light output of the light emitting member is configured to be set by programming the adjustment member.

3. The lighting device of claim 1, wherein the light emitting member is a light-emitting diode (LED).

4. The lighting device of claim 1, wherein the housing is a work lamp.

5. The lighting device of claim 1, wherein the housing is a lamp for surgery.

6. The lighting device of claim 1, wherein the housing is a table lamp.

* * * * *